US006913272B2

(12) United States Patent
Chang

(10) Patent No.: US 6,913,272 B2
(45) Date of Patent: Jul. 5, 2005

(54) SKATEBOARD HAVING A THREE-DIMENSIONAL INDEPENDENT SUSPENSION BALANCE SYSTEM

(76) Inventor: Chuck Chang, No. 176-3, Guangming Rd., Taichung (TW)

( * ) Notice: Subject to any disclaimer, the term of this patent is extended or adjusted under 35 U.S.C. 154(b) by 0 days.

(21) Appl. No.: 10/612,907

(22) Filed: Jul. 7, 2003

(65) Prior Publication Data

US 2004/0036243 A1 Feb. 26, 2004

(30) Foreign Application Priority Data

Aug. 23, 2002 (TW) ..... 91119322 A
Dec. 17, 2002 (TW) ..... 91220605 A

(51) Int. Cl.[7] ..... B62M 1/00; A63C 1/24

(52) U.S. Cl. ..... 280/87.042; 280/87.041; 280/11.28

(58) Field of Search ..... 280/87.042, 87.041, 280/87.01, 87.021, 11.27, 11.28, 11.19

(56) References Cited

U.S. PATENT DOCUMENTS 4,168,075 A * 9/1979 Matschinsky ..... 280/5.52
4,176,850 A * 12/1979 Johnson ..... 280/87.042
4,181,316 A * 1/1980 Brand et al. ..... 280/11.207
4,337,961 A * 7/1982 Covert et al. ..... 280/87.042
4,645,223 A * 2/1987 Grossman ..... 280/11.28
5,868,408 A * 2/1999 Miller ..... 280/87.042
6,793,224 B2 * 9/2004 Stratton ..... 280/87.042

* cited by examiner

*Primary Examiner*—Christopher P. Ellis
*Assistant Examiner*—G B Klebe
(74) *Attorney, Agent, or Firm*—Rosenberg, Klein & Lee

(57) ABSTRACT

A skateboard includes a board body having a bottom provided with a base having a bottom provided with two opposite wheel seats. Each of the two wheel seats includes a wheel axle for mounting a roller. The wheel axle of each of the two wheel seats has a center located at a height different from that of a center of the respective wheel seat, thereby forming an eccentric state, so that each roller has independent horizontal and vertical displacement, thereby forming a balance effect, so that the skateboard can be moved in a stable manner.

15 Claims, 19 Drawing Sheets

SKATEBOARD HAVING A THREE-DIMENSIONAL INDEPENDENT SUSPENSION BALANCE SYSTEM

BACKGROUND OF THE INVENTION

1. Field of the Invention

The present invention relates to a skateboard having a three-dimensional independent suspension balance system, and more particularly to a skateboard, wherein each of the rollers has independent horizontal and vertical displacement, thereby forming an excellent balance effect, so that the skateboard can be moved in a stable manner.

2. Description of the Related Art

A first conventional skateboard 10B in accordance with the prior art shown in FIGS. 15–17 comprises a board body 11B, two bases 12B each mounted on the bottom of the board body 11B, and two wheel seats 13B each mounted on the bottom of a respective one of the two bases 12B for supporting two rollers 14B by a wheel axle 15B.

However, the first conventional skateboard 10B has the following disadvantages.

1. Each of the two wheel seats 13B can be rotated through a little angle only, thereby causing instability when the skateboard 10B is turned, and thereby affecting the user's safety.

2. As shown in FIG. 15, each of the two wheel seats 13B can be rotated through a little angle only, so that the rotation diameter "R" of the board body 11B is very large, thereby decreasing mobility of the skateboard 10B when turning.

3. As shown in FIG. 16, when either one roller 14B is blocked, the roller 14B produces a height differential ΔH, and the board body 11B produces a larger height differential ΔH', thereby decreasing stability of the skateboard 10B when moving.

4. When the rollers 14B are subjected to shock or vibration, the shock or vibration is directly transmitted to the board body 11B, thereby causing an uncomfortable sensation to the user.

5. As shown in FIG. 17, when either roller 14B is blocked, one of the two wheel seats 13B is deflected and directed toward the direction "D1" which deviates from the travel direction "D0" of the skateboard 10B, thereby decreasing stability of the skateboard 10B when moving.

A second conventional skateboard 10C in accordance with the prior art shown in FIGS. 18 and 19 comprises a board body 11C, and two bases 12C each mounted on the bottom of the board body 11C. Each of the two bases 12C is provided with a rotation disk 16C having two ends each pivoted with a primary wheel arm 17C which is provided with a roller 14C. The primary wheel arm 17C has a mediate portion provided with a secondary wheel arm 18C which is pivotally connected with a drawing arm 19C which is extended through the base 12C.

However, the second conventional skateboard 10C has the following disadvantages.

1. The second conventional skateboard 10C is expensive, thereby increasing costs of fabrication.

2. The second conventional skateboard 10C has a heavy weight and a large volume, thereby causing inconvenience to the user in transportation and storage.

3. The primary wheel arm 17C is interconnected with the secondary wheel arm 18C, thereby affecting displacement of the roller 14C at the other end, and thereby decreasing stability of the skateboard 10C when moving.

4. The second conventional skateboard 10C has a higher center of gravity, thereby decreasing stability of the skateboard 10C when moving.

5. Each of the rollers 14C is distantly spaced from the board body 11C, so that the user's one foot easily hits the roller 14C, thereby causing inconvenience in use.

The closest prior art references of which the applicant is aware are disclosed in U.S. Pat. No. 5,263,725 and U.S. Pat. No. 5,997,018.

SUMMARY OF THE INVENTION

The primary objective of the present invention is to provide a skateboard having a three-dimensional independent suspension balance system.

Another objective of the present invention is to provide a skateboard, wherein each of the rollers has independent horizontal and vertical displacement, thereby forming an excellent balance effect, so that the skateboard can be moved in a stable manner.

A further objective of the present invention is to provide a skateboard, wherein the main seat can be rotated relative to the base, so that when the board body is pressed, the main seat restoring device can be compressed or loosened, and the main seat can be deflected, so as to produce a smaller rotation diameter, thereby enhancing movability of the skateboard when turning.

A further objective of the present invention is to provide a skateboard, wherein when a single roller is blocked by an obstruction, the roller can adjust its position automatically, so that the roller is rotated about the wheel seat pivot shaft to deflect upward. Thus, the board body maintain a horizontal state to move in the forward direction stably, thereby enhancing stability of the skateboard when moving.

A further objective of the present invention is to provide a skateboard, wherein when the rollers are subjected to shock or vibration, the main seat restoring device and the two wheel seat restoring devices provide a cushioning effect to prevent the snock or vibration from being transmitted to the base or the main seat, thereby providing a shock absorbing and cushioning effect.

A further objective of the present invention is to provide a skateboard, wherein the board body is moved in a stable manner, thereby enhancing safety of the skateboard when moving.

A further objective of the present invention is to provide a skateboard, wherein the main seat can be rotated relative to the base and each of the two wheel seats can be rotated relative to the main seat, thereby producing a three-dimensional movement, and thereby enhancing versatility of the skateboard.

A further objective of the present invention is to provide a skateboard, wherein the skateboard has an excellent balance effect by design of the main seat restoring device and the two wheel seat restoring devices.

In accordance with the present invention, there is provided a skateboard comprising:

a board body having a bottom provided with a base;

the base having a bottom provided with two opposite wheel seats;

each of the two wheel seats including a wheel axle for mounting a roller;

wherein, the wheel axle of each of the two wheel seats has a center located at a height different from that of a center of the respective wheel seat, thereby forming an eccentric state, so that each roller has independent horizontal and vertical displacement.

Further benefits and advantages of the present invention will become apparent after a careful reading of the detailed description with appropriate reference to the accompanying drawings.

DETAILED DESCRIPTION OF THE INVENTION

Figure 1:
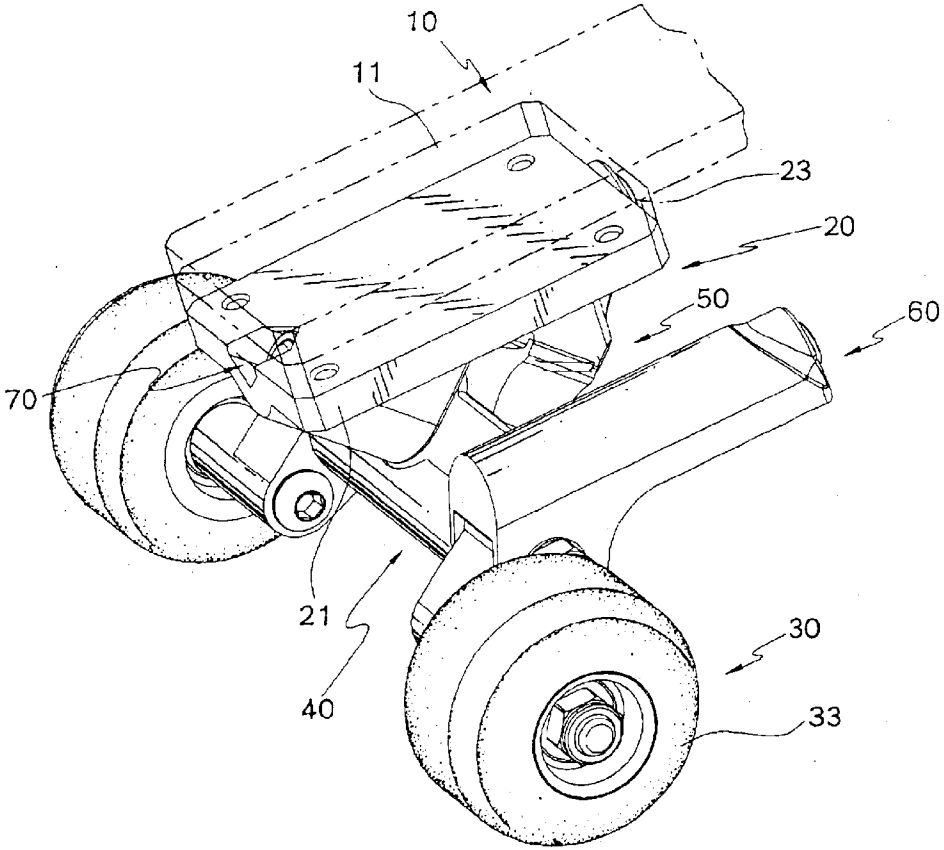
FIG. 1 is a partially cut-away perspective view of a skateboard in accordance with the preferred embodiment of the present invention.
Figure 2:
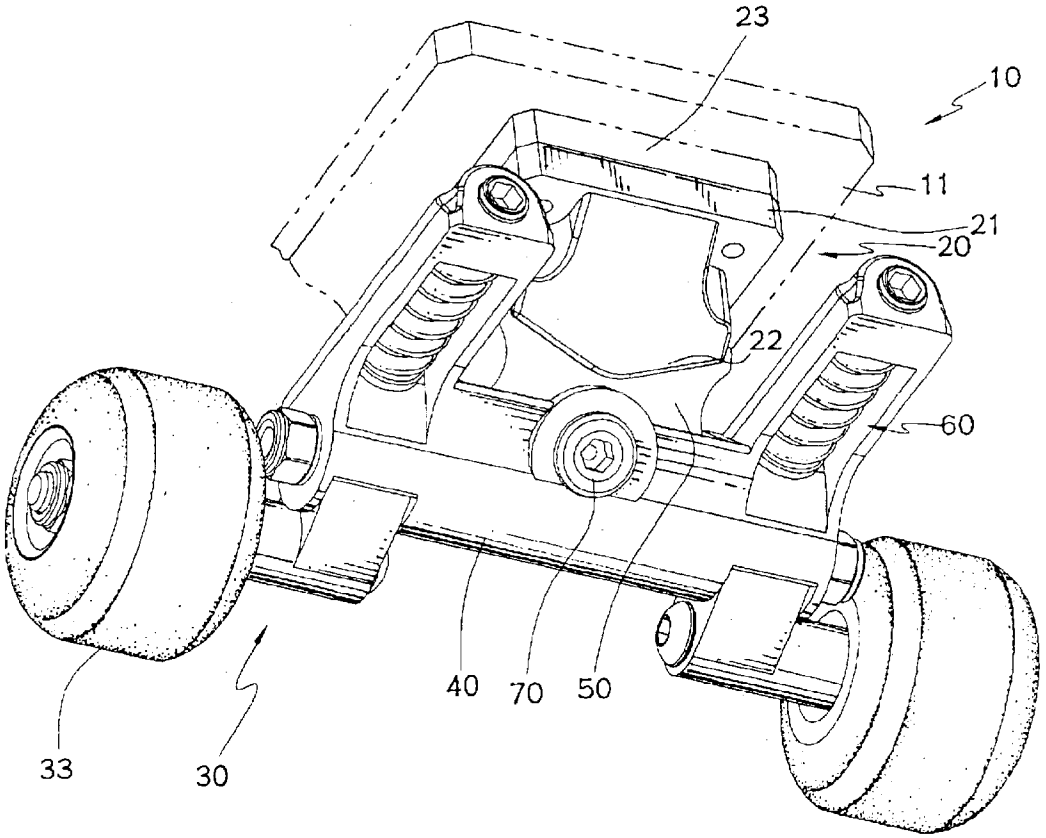
FIG. 2 is a perspective view of the skateboard in accordance with the preferred embodiment of the present invention.

Referring to the drawings and initially to FIGS. 1–6, a skateboard 10 having a three-dimensional independent suspension balance system in accordance with the preferred embodiment of the present invention comprises a board body 11 having a bottom having a front end and a rear end each provided with a base 20. The base 20 has a top formed with a fixing portion 21 fixed on the board body 11. The base 20 has a bottom provided with two opposite wheel seats 30. Each of the two wheel seats 30 includes a wheel axle for mounting a roller 33 by a bearing 32. An adjusting member 23 is mounted between the board body 11 and the fixing portion 21 of the base 20 for adjusting the distance between the board body 11 and the base 20, so as to fit rollers 33 of different diameters.

The center of the wheel axle 31 of each of the two wheel seats 30 is located at a height different from that of the center of the respective wheel seat 30, thereby forming an eccentric state, so that each roller 33 has independent horizontal and vertical displacement, thereby providing a steady buffering effect during movement.

The skateboard 10 further comprises a main seat 40 mounted between the base 20 and the two wheel seats 30. Preferably, the main seat 40 has a top rotatably mounted on the base 20 by a base pivot shaft 70, and each of the two wheel seats 30 is rotatably mounted on a bottom of the main seat 40 by a wheel seat pivot shaft 80. The wheel axle 31 of each of the two wheel seats 30 is located at a height different from that of the respective wheel seat pivot shaft 80, thereby forming an eccentric state, so that each roller 33 on the wheel axle 31 has independent horizontal and vertical displacement and has independent buffer displacement, thereby providing a steady buffering effect during movement.

The skateboard 10 further comprises a main seat restoring device 50 mounted between the base 20 and the main seat 40 to provide a shock-absorbing effect to the base 20 and the main seat 40, and two wheel seat restoring devices 60 each mounted between the main seat 40 and a respective one of the two wheel seats 30 to provide a shock-absorbing effect to the main seat 40 and the respective wheel seat 30.

The top of the main seat 40 is formed with a base receiving portion 41. The bottom of the base 20 is formed with an inverted V-shaped connecting portion 22 rotatably mounted on the base receiving portion 41 of the main seat 40.

The connecting portion 22 of the base 20 has a first side rotatably mounted on a first side of the base receiving portion 41 of the main seat 40. Preferably, the first side of the base receiving portion 41 of the main seat 40 is formed with an arcuate guide edge 410, and the first side of the connecting portion 22 of the base 20 is formed with an arcuate guide edge 220 rested on the guide edge 410 of the base receiving portion 41, so that the connecting portion 22 of the base 20 is rotated on the base receiving portion 41 of the main seat 40 conveniently.

The connecting portion 22 of the base 20 has a second side provided with an urging portion 221 having a distal end formed with a protruding retaining edge 222. The base receiving portion 41 of the main seat 40 has a second side provided with a U-shaped urging portion 411.

The main seat restoring device 50 is clamped between the urging portion 221 of the connecting portion 22 of the base 20 and the urging portion 411 of the base receiving portion 41 of the main seat 40 and is retained by the retaining edge 222, so that the main seat 40 has an automatically restoring function. Preferably, the main seat restoring device 50 includes a restoring member 51 made of an elastic block.

Figure 3:
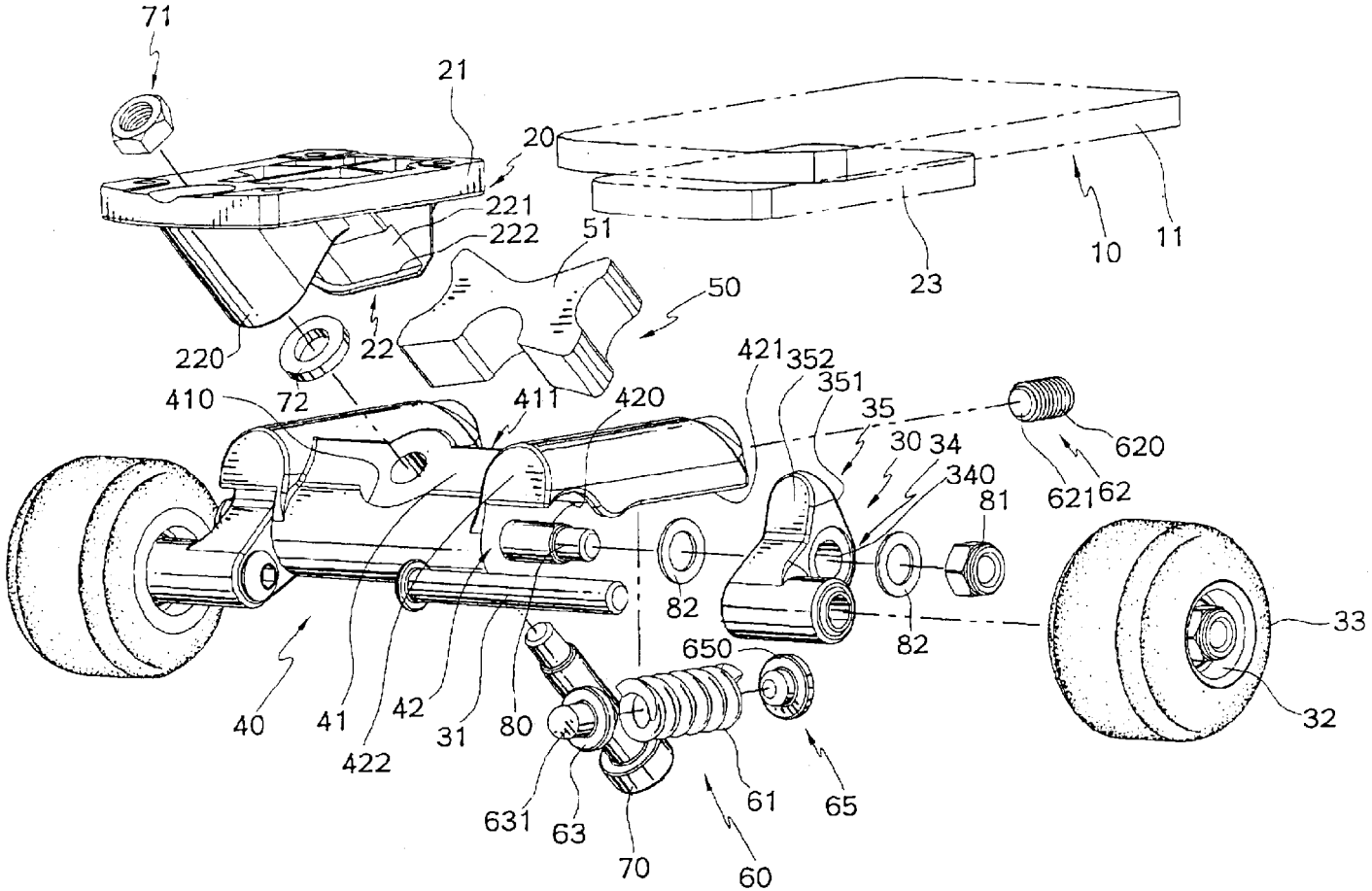
FIG. 3 is a partially exploded perspective view of the skateboard in accordance with the preferred embodiment of the present invention.
Figure 5:
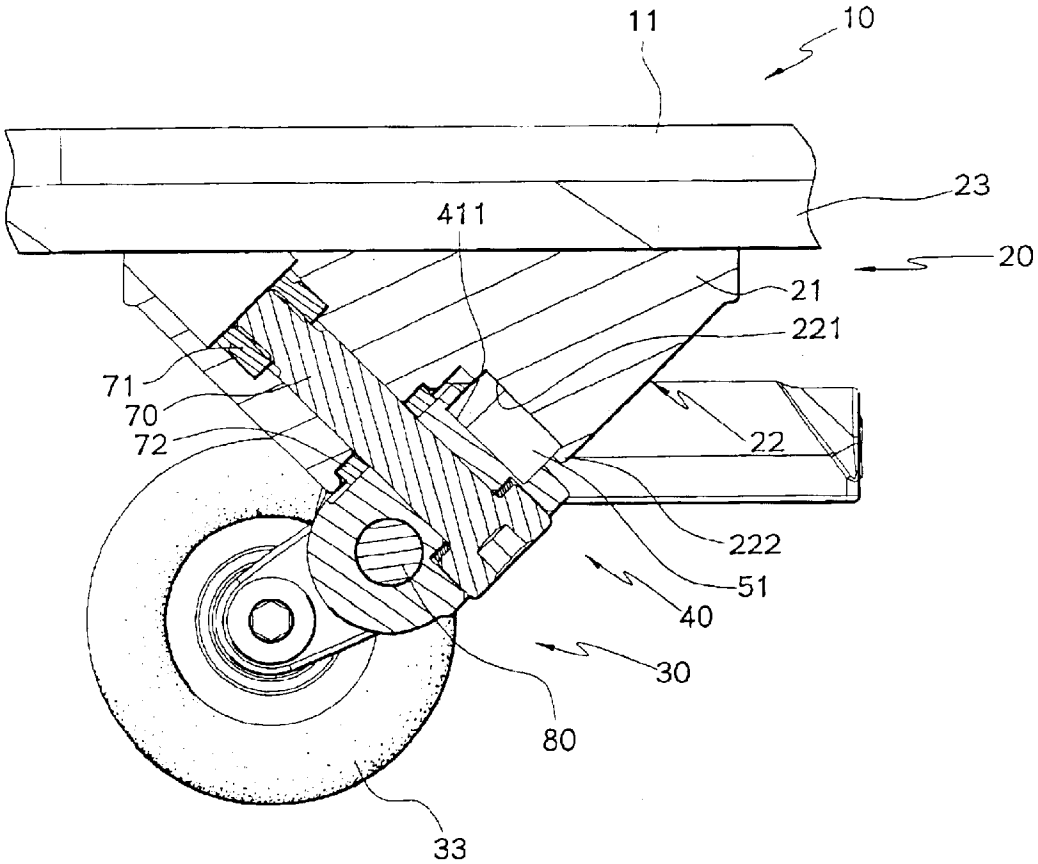
FIG. 5 is a partially cut-away side plan cross-sectional assembly view of the skateboard as shown in FIG. 3.

As shown in FIGS. 3 and 5, the base pivot shaft 70 is extended through the first side of the connecting portion 22 of the base 20 and the first side of the base receiving portion 41 of the main seat 40 and has a distal end screwed with a fixing member 71 (such as a nut), so that the main seat 40 can be rotated on the base 20 about the base pivot shaft 70. The skateboard 10 further comprises a bushing 72 made of wear-resistant material mounted on the base pivot shaft 70 and located between the first side of the connecting portion 22 of the base 20 and the first side of the base receiving portion 41 of the main seat 40 to decrease friction between the base pivot shaft 70, the base 20 and the main seat 40.

Figure 4:
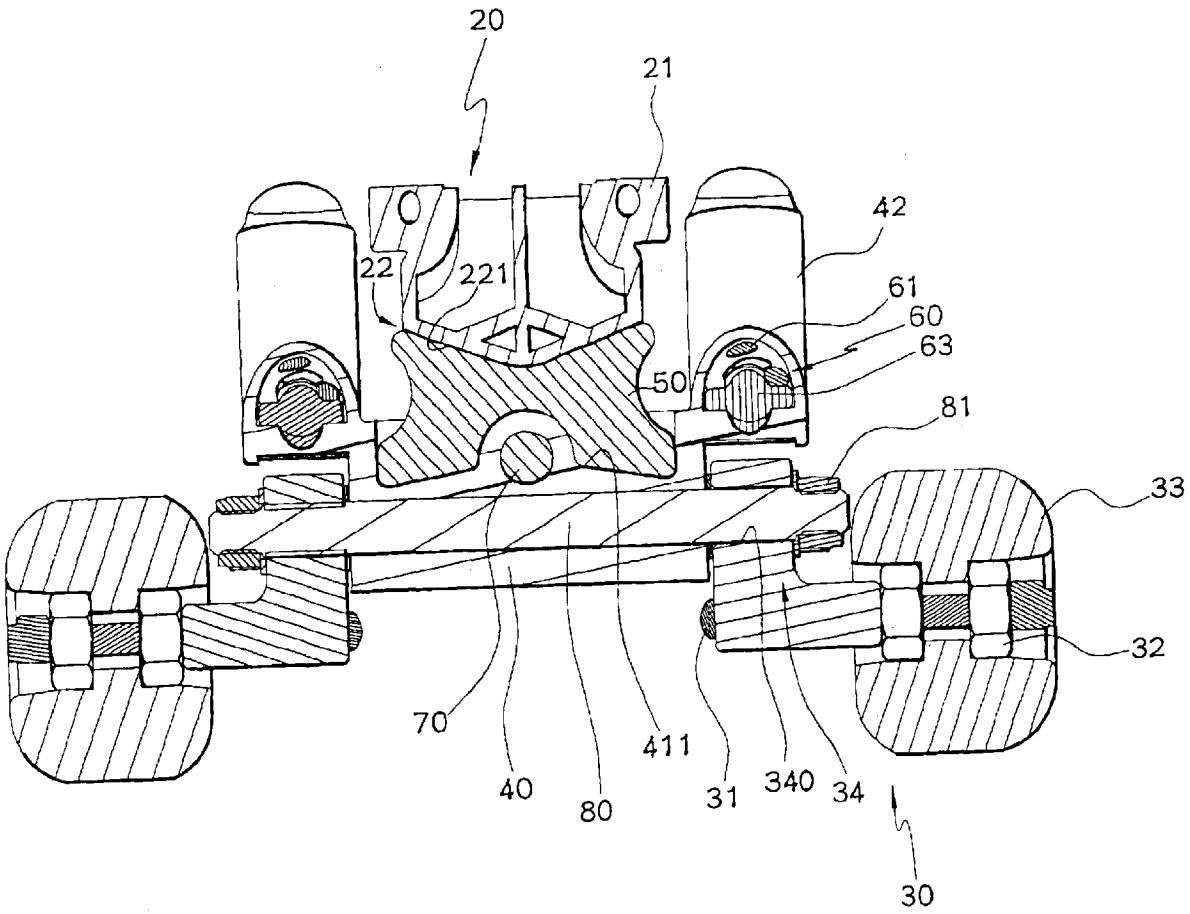
FIG. 4 is a front plan cross-sectional assembly view of the skateboard as shown in FIG. 3.

As shown in FIGS. 3 and 4, each of the two wheel seats 30 has a mediate portion formed with a shaft passage portion 34 having a center formed with a shaft hole 340. The wheel seat pivot shaft 80 is extended through the shaft hole 340 of the shaft passage portion 34 of each of the two wheel seats 30 and through the main seat 40 and has two ends each protruding outward from a respective one of the two wheel seats 30 and each screwed with a threaded fixing member 81 (such as a nut). Thus, each of the two wheel seats 30 can be rotated on the main seat 40 about the wheel seat pivot shaft 80. Preferably, a bushing 82 is mounted between the wheel seat pivot shaft 80 and the fixing member 81. In addition, the wheel axle 31 of each of the two wheel seats 30 is located at a height different from that of the respective wheel seat pivot shaft 80, thereby forming an eccentric state, so that each roller 33 on the wheel axle 31 has independent horizontal and vertical displacement during rotation of the respective wheel seat 30, thereby providing a steady buffering effect during movement.

As shown in FIGS. 3–6, the bottom of the main seat 40 has two ends each provided with a wheel seat receiving portion 42. The wheel seat receiving portion 42 of the main seat 40 has a first end formed with a guide channel 420, a second end formed with a receiving channel 421, and a mediate portion formed with a partition 424 located between the guide channel 420 and the receiving channel 421.

Figure 6:
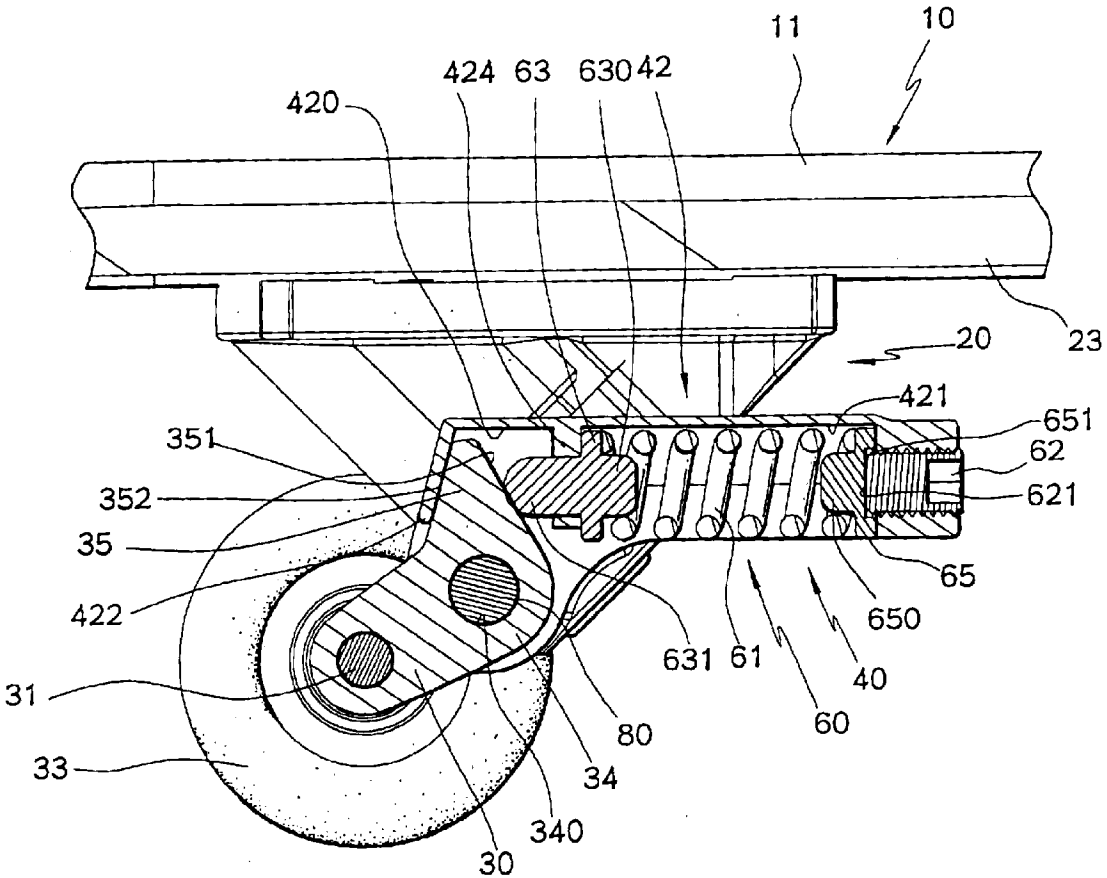
FIG. 6 is a partially cut-away side plan cross-sectional assembly view of the skateboard as shown in FIG. 3.
Figure 11:
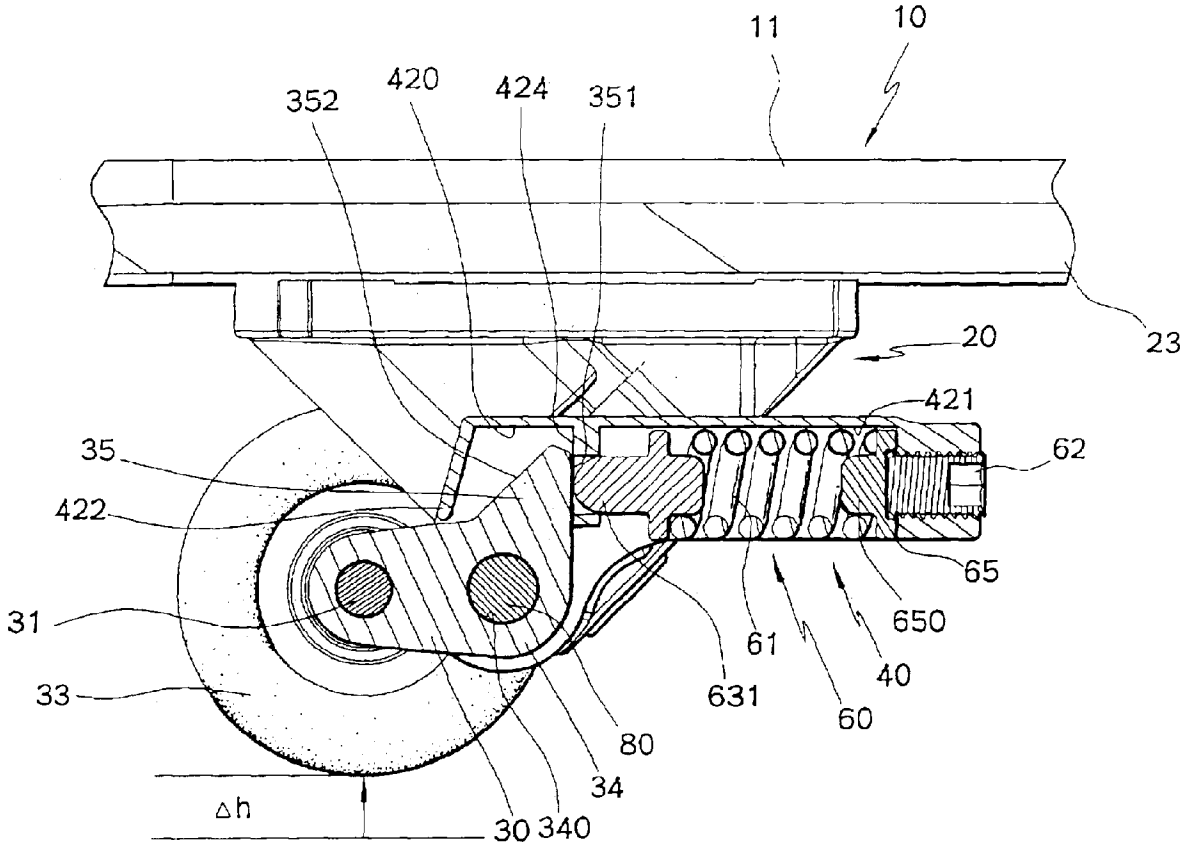
FIG. 11 is a schematic operational view of the skateboard as shown in FIG. 6 in use.

Each of the two wheel seats 30 is mounted in the wheel seat receiving portion 42 of the main seat 40 and has a first end formed with a protruding restoring portion 35 movably mounted in the guide channel 420 of the wheel seat receiving portion 42 of the main seat 40. Each of the two wheel seats 30 has a second end for passage of the respective wheel axle 31. The restoring portion 35 of each of the two wheel seats 30 has a first side formed with a locking edge 352 that can be moved to abut a wall of the guide channel 420 of the wheel seat receiving portion 42 of the main seat 40 as shown in FIG. 6 and a second side formed with a resting edge 351 that can be moved to abut the partition 424 of the wheel seat receiving portion 42 of the main seat 40 as shown in FIG. 11.

Each of the two wheel seat restoring devices 60 is mounted in the wheel seat receiving portion 42 of the main seat 40.

Each of the two wheel seat restoring devices 60 includes a restoring member 61 mounted in the receiving channel 421 of the wheel seat receiving portion 42 of the main seat 40 and urged between the partition 424 and a wall of the receiving channel 421, and an urging seat 63 movably mounted in the receiving channel 421 of the wheel seat receiving portion 42 of the main seat and having a first side formed with a fixing portion 630 fixed on a first end of the restoring member 61 and a second side formed with an urging portion 631 urged on the resting edge 351 of the restoring portion 35 of the respective wheel seat 30. Preferably, the urging seat 63 is rested on the partition 424 of the wheel seat receiving portion 42 of the main seat 40, and the urging portion 631 of the urging seat 63 is extended through the partition 424 of the wheel seat receiving portion 42 of the main seat 40.

Each of the two wheel seat restoring devices 60 further includes an adjusting seat 65 movably mounted in the receiving channel 421 of the wheel seat receiving portion 42 of the main seat 40 and having a first side formed with a fixing portion 650 fixed on a second end of the restoring member 61 and a second side rested on a wall of the receiving channel 421 of the wheel seat receiving portion 42 of the main seat 40.

Each of the two wheel seat restoring devices 60 further includes an adjusting screw 62 screwed into the wall of the receiving channel 421 of the wheel seat receiving portion 42 of the main seat 40 and having an end formed with an urging face 621 urged on the second side of the adjusting seat 65. Preferably, the second side of the adjusting seat 65 is formed with a depression 651 to receive the urging face 621 of the adjusting screw 62. Thus, the adjusting screw 62 can be rotated to urge and move the adjusting seat 65 to compress the restoring member 61 so as to adjust the tension of the restoring member 61.

Accordingly, the skateboard 10 in accordance with the present invention has the following advantages.

Figure 7:
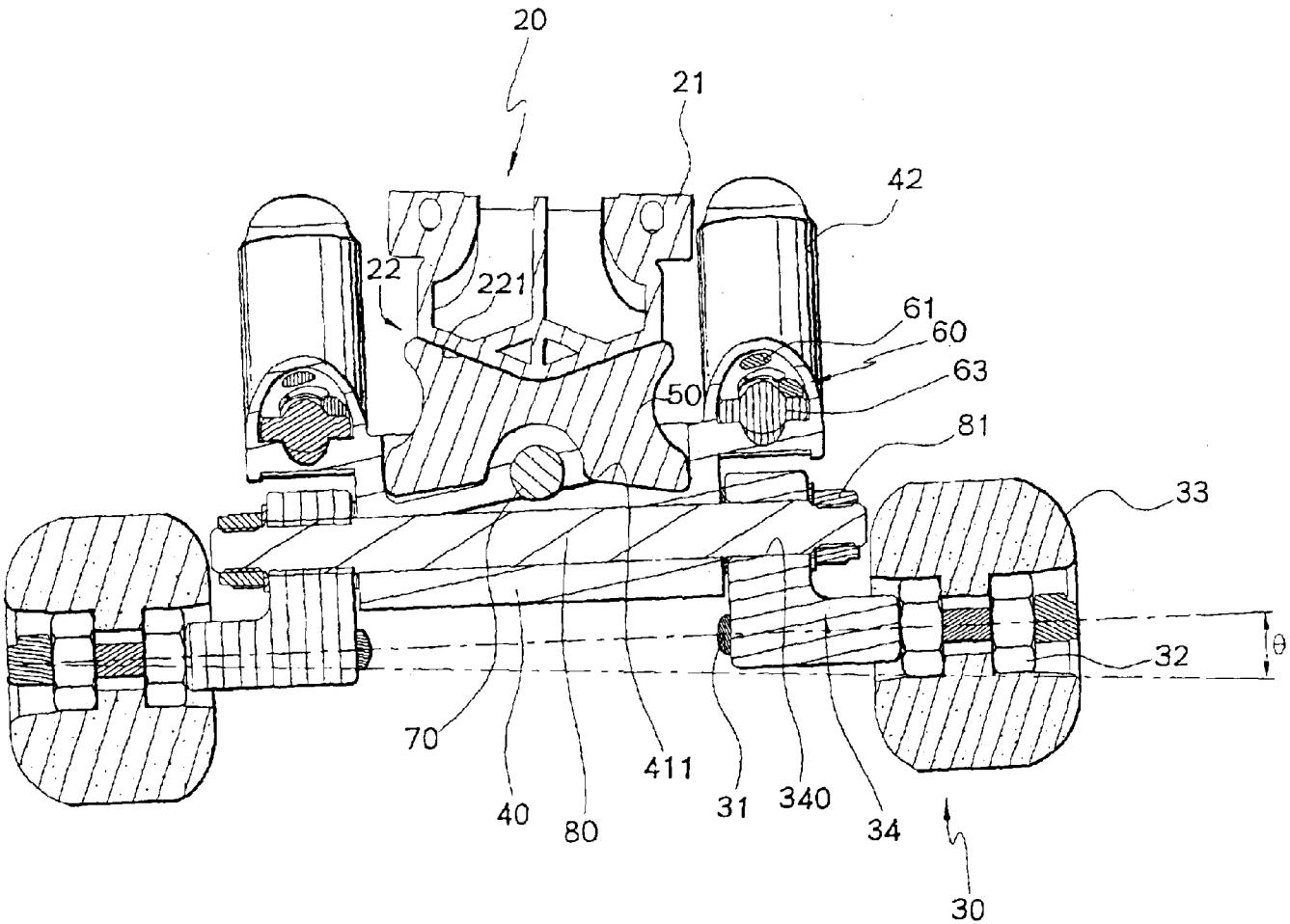
FIG. 7 is a schematic operational view of the skateboard as shown in FIG. 4 in use.
Figure 8:
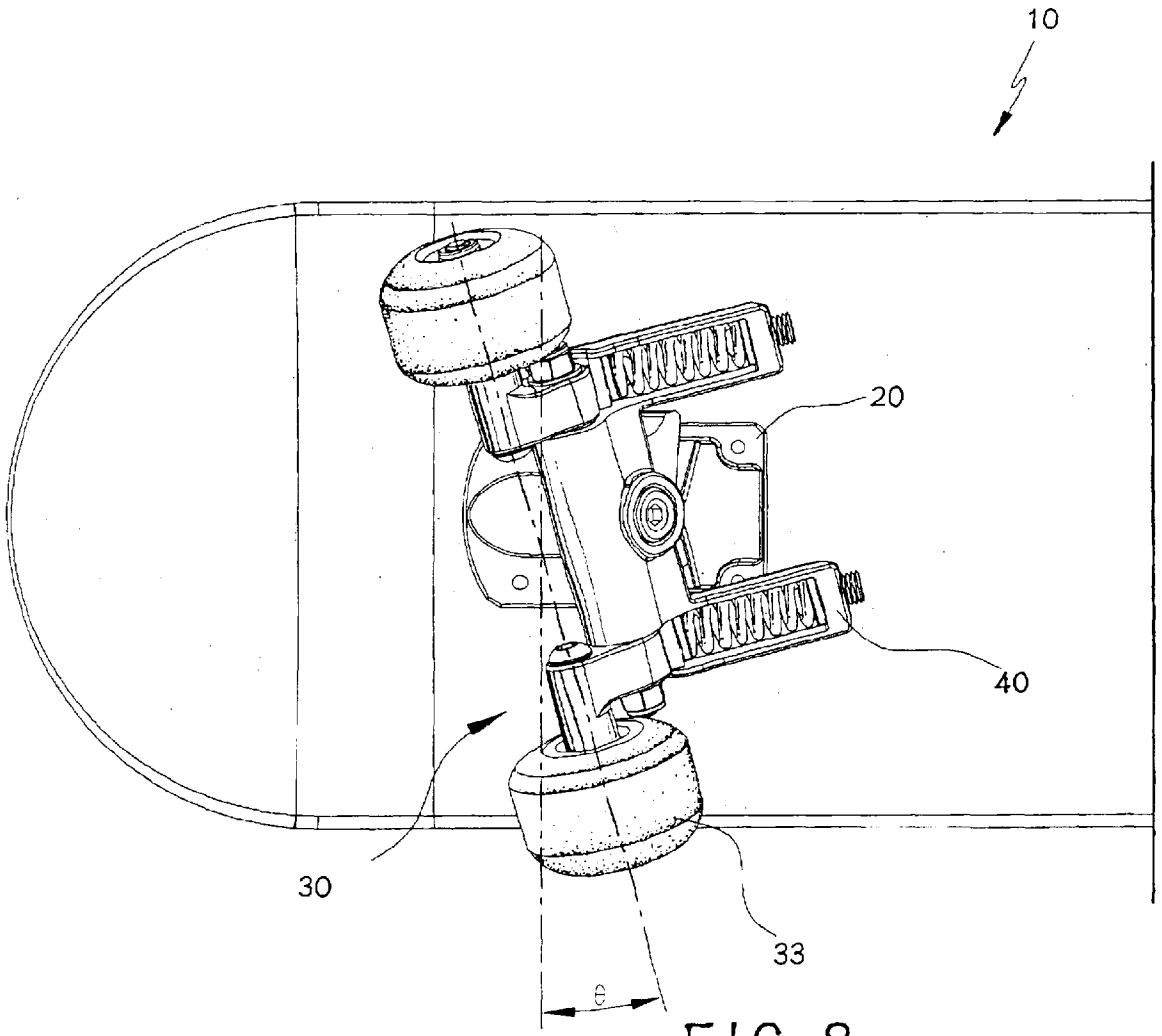
FIG. 8 is a partially cut-away schematic bottom plan operational view of the skateboard as shown in FIG. 2 in use.
Figure 9:
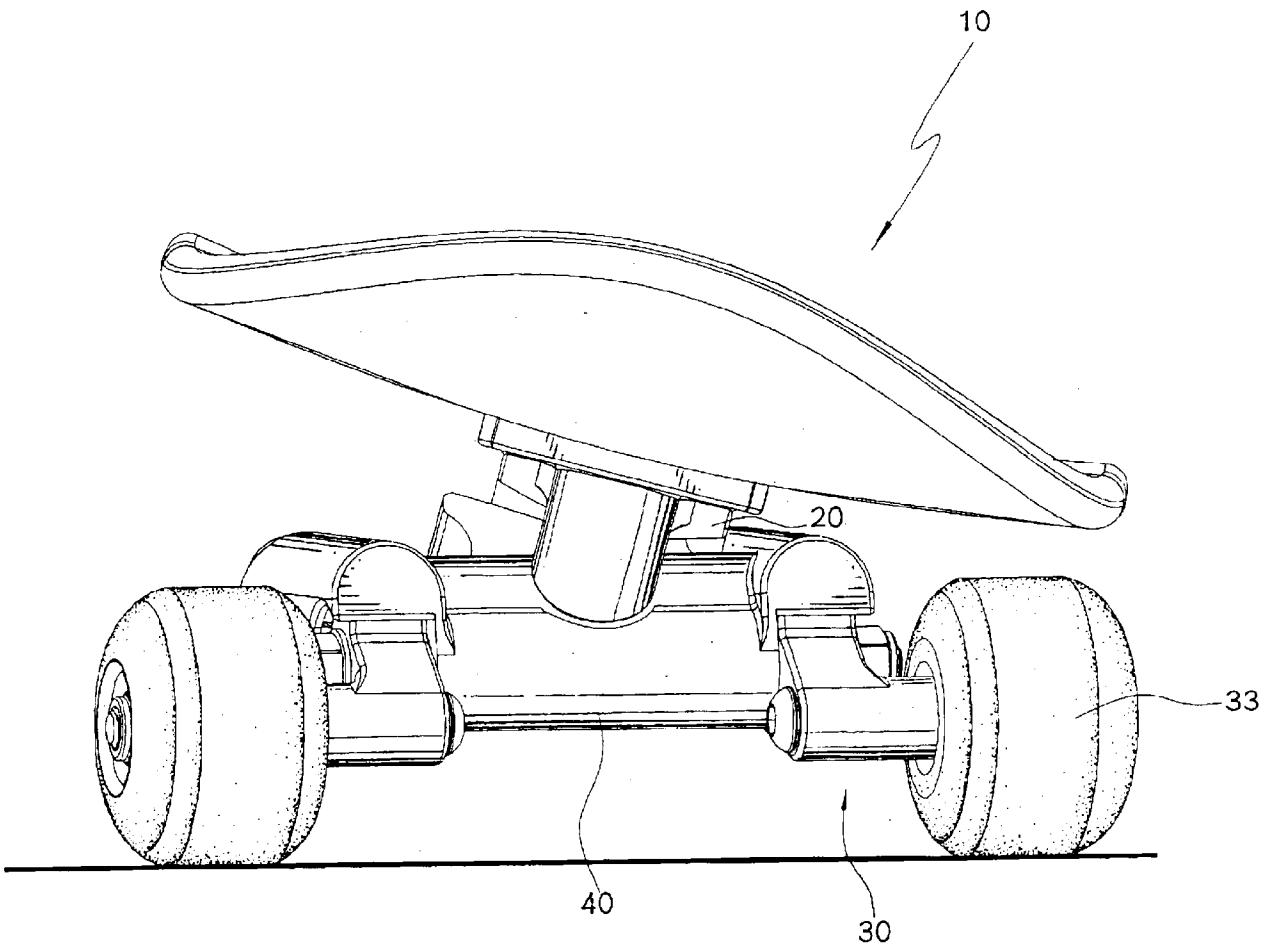
FIG. 9 is a schematic plan operational view of the skateboard in accordance with the preferred embodiment of the present invention.
Figure 10:
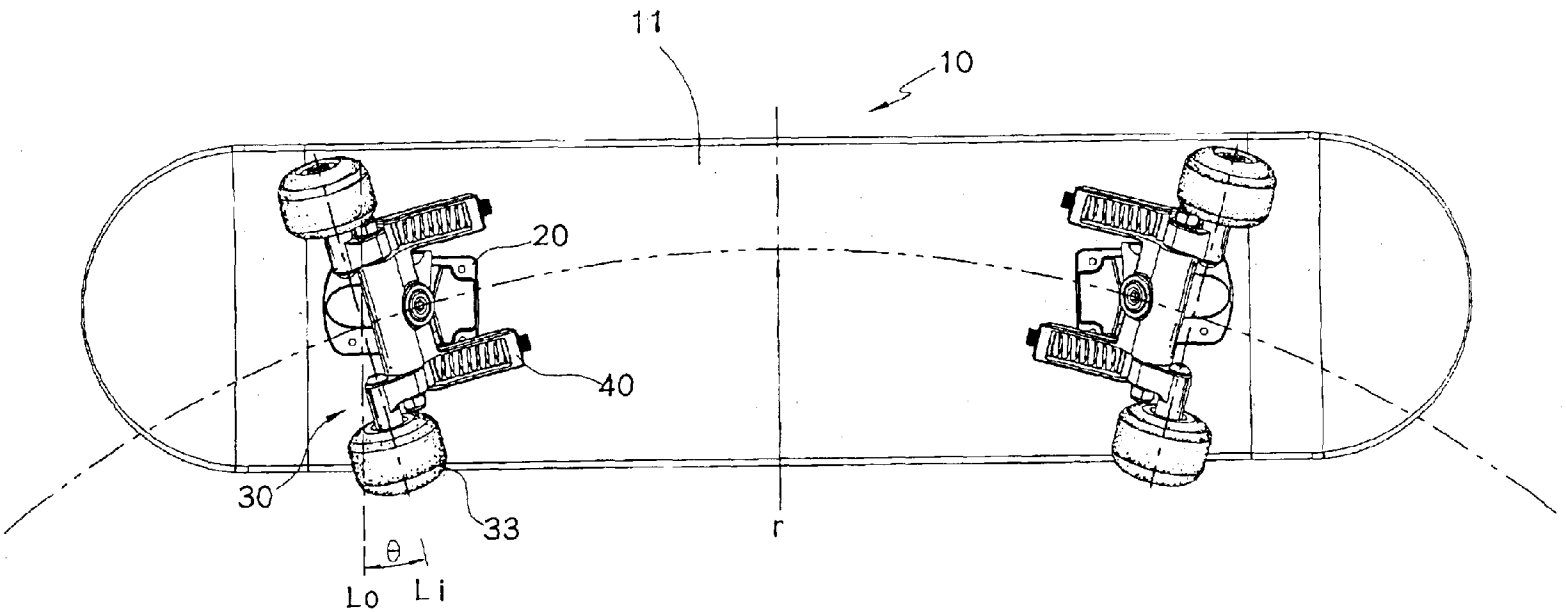
FIG. 10 is a schematic bottom plan operational view of the skateboard as shown in FIG. 2 in use.

1. The main seat 40 can be rotated relative to the base 20, so that when the board body 11 is pressed, the main seat restoring device 50 between the base 20 and the main seat 40 can be compressed as shown in FIGS. 7–9 to provide a shock-absorbing effect to the base 20 and the main seat 40, and the main seat 40 can be deflected from the axis $L_0$ to the axis $L_1$ to produce a deflection angle θ as shown in FIG. 10, so as to produce a smaller rotation diameter "r", thereby enhancing mobility of the skateboard 10 when turning.

Figure 12:
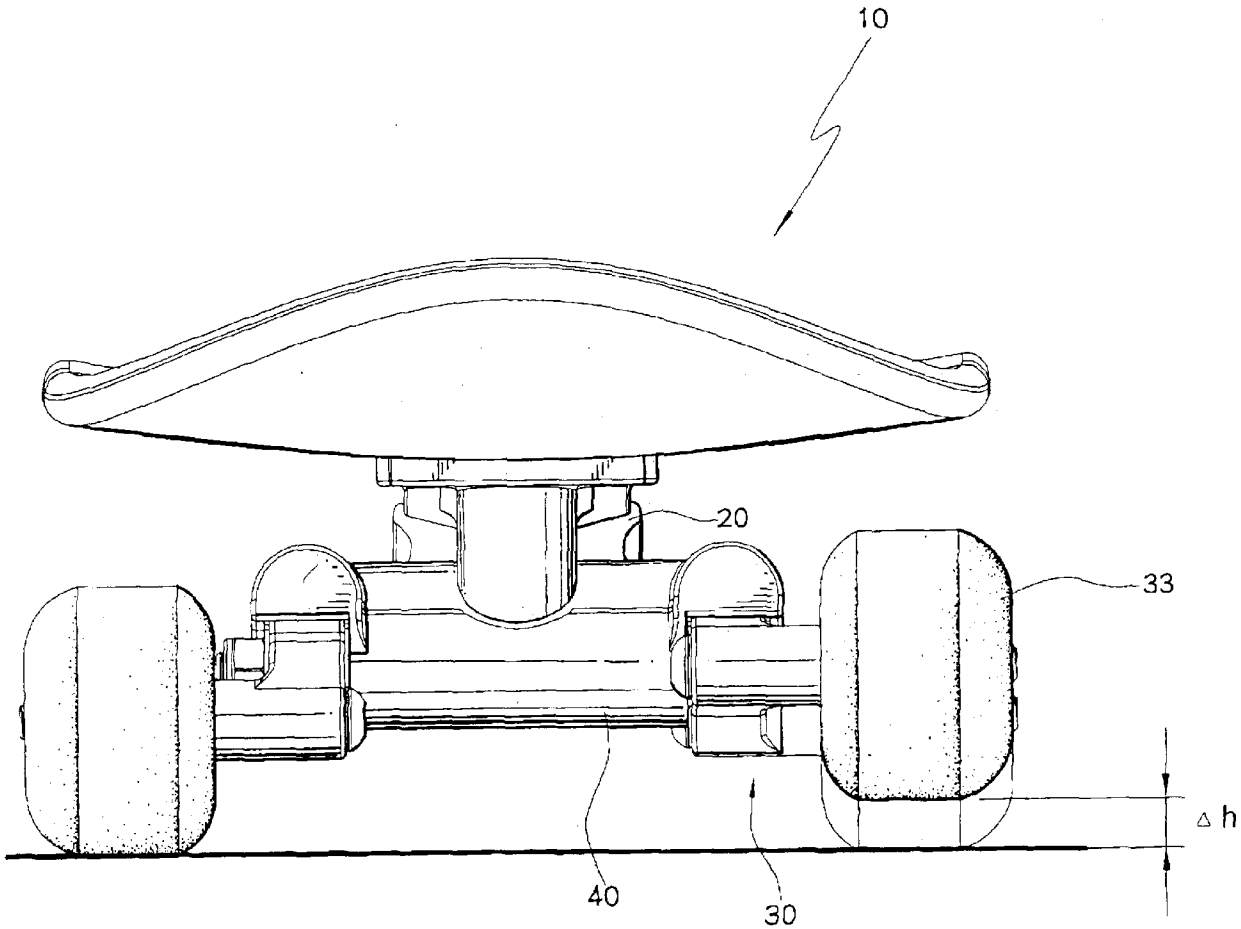
FIG. 12 is a schematic operational view of the skateboard as shown in FIG. 9 in use.
Figure 13:
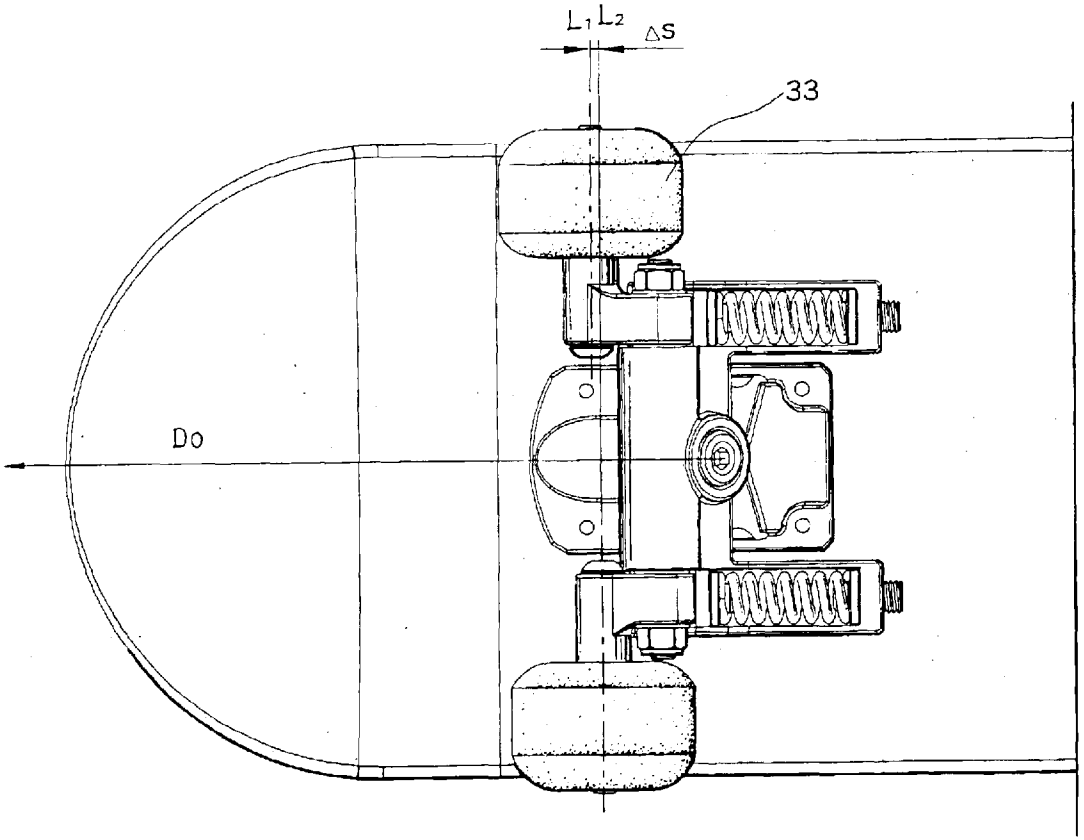
FIG. 13 is a partially cut-away schematic bottom plan operational view of the skateboard as shown in FIG. 2 in use.

2. When either roller 33 is blocked by an obstruction, the roller 33 can be deflected to produce different displacement as shown in FIGS. 11 and 12 to adjust its position automatically, so that the roller 33 is rotated about the wheel seat pivot shaft 80 to deflect upward through the height of "Δh" as shown in FIGS. 11 and 12. In such a manner, the roller 33 is moved back from the axis $L_1$ to the axis $L_2$ to produce a delay ΔS deflection angle θ as shown in FIG. 13. Thus, the board body 11 maintain a horizontal state, so as to move in the forward direction "D0" stably as shown in FIG. 13, thereby enhancing stability of the skateboard 10 when moving.

3. When the rollers 33 are subjected to shock or vibration, the main seat restoring device 50 and the two wheel seat restoring devices 60 provide a cushioning effect to prevent the shock or vibration from being transmitted to the base 20 or the main seat 40, thereby providing a shock absorbing and cushioning effect.

4. The board body 11 is moved in a stable manner, thereby enhancing safety of the skateboard 10 when moving.

5. The main seat 40 can be rotated relative to the base 20 and each of the two wheel seats 30 can be rotated relative to the main seat 40, thereby producing a three-dimensional movement, and thereby enhancing versatility of the skateboard 10.

6. The skateboard 10 has an excellent balance effect by design of the main seat restoring device 50 and the two wheel seat restoring devices 60.

Figure 14:
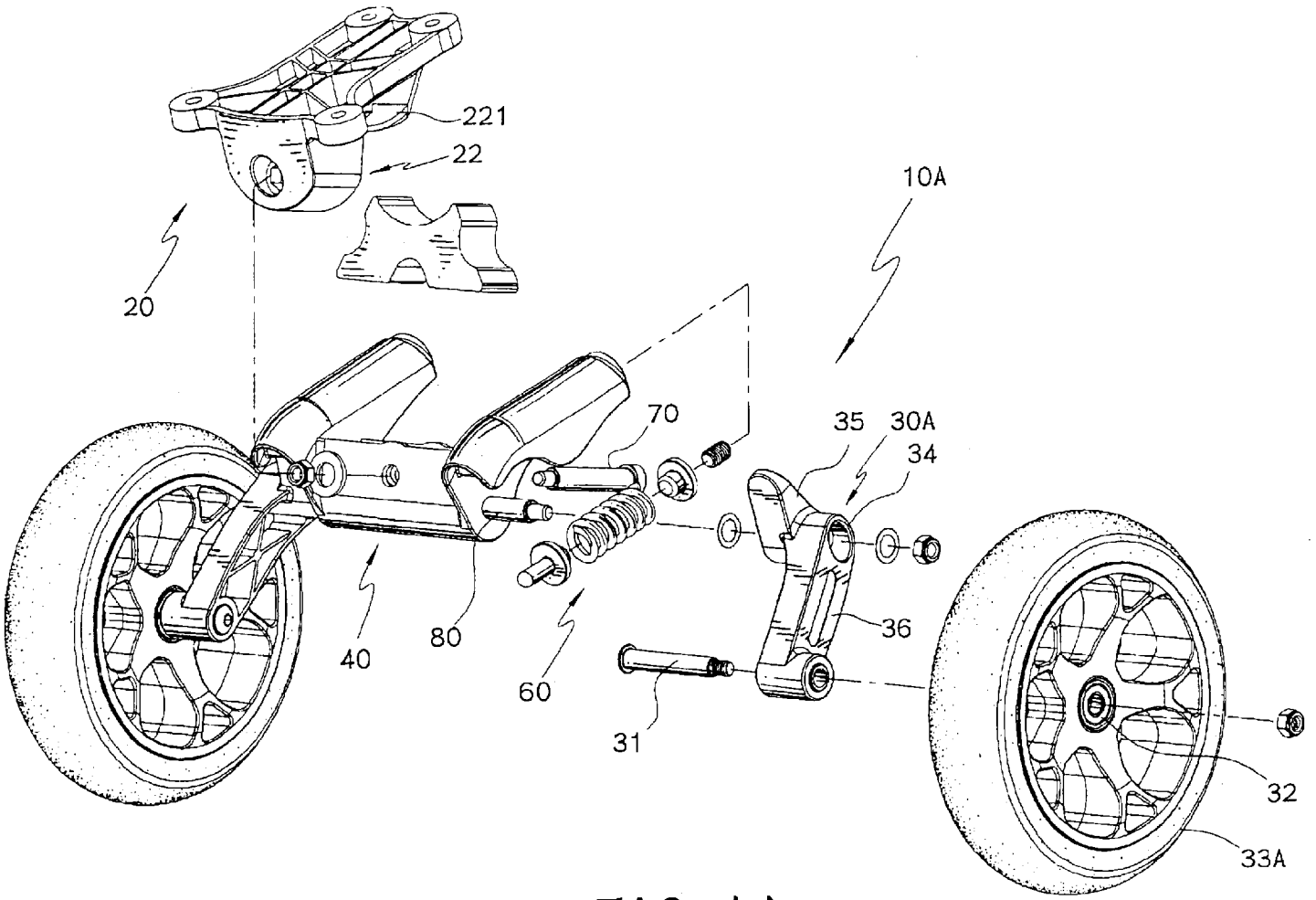
FIG. 14 is an exploded perspective view of a skateboard in accordance with another embodiment of the present invention.
Figure 15:
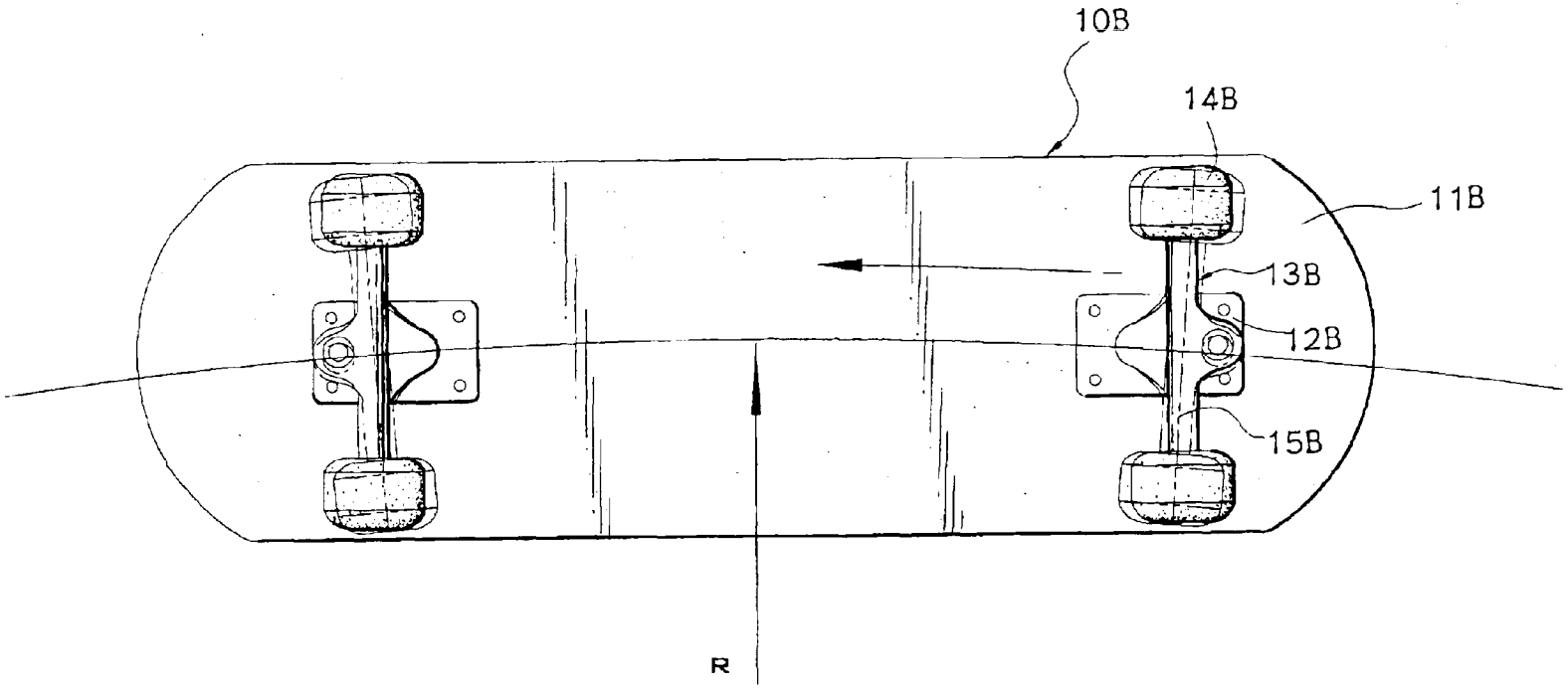
FIG. 15 is a schematic plan operation view of a first conventional skateboard in accordance with the prior art.
Figure 16:
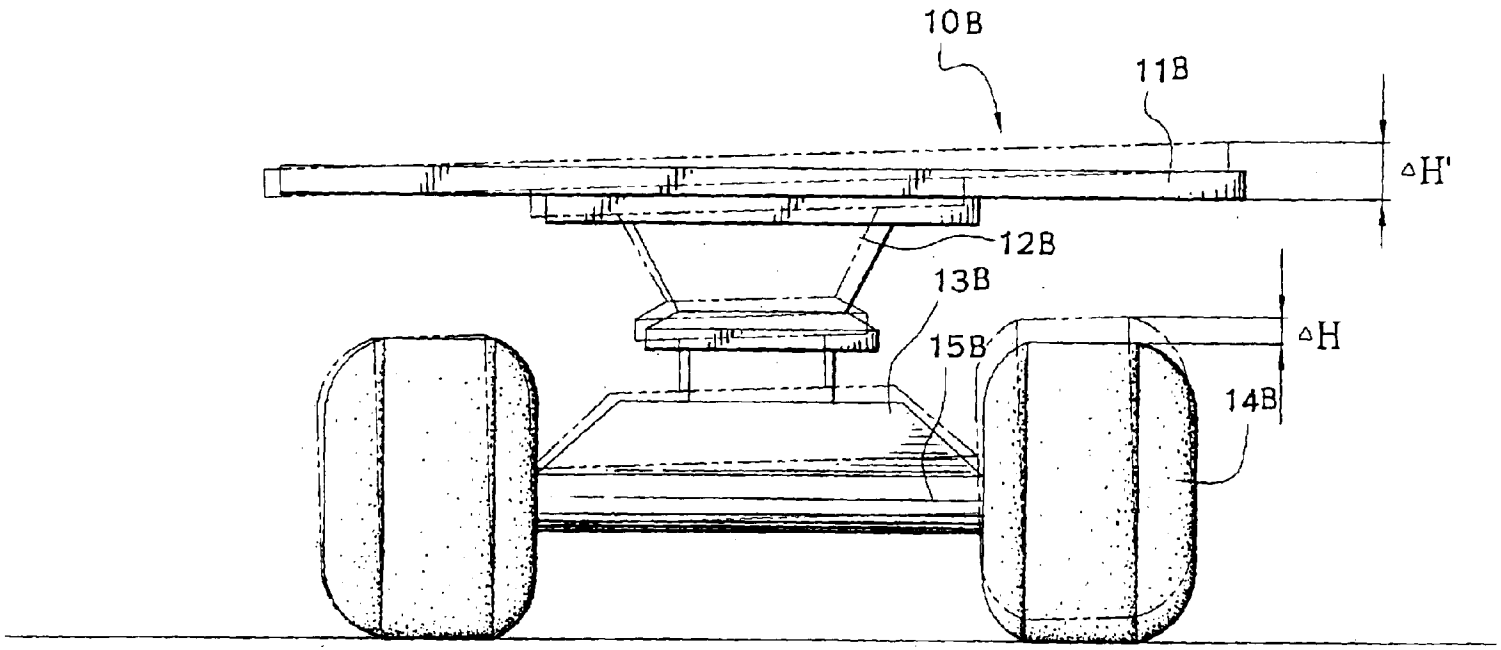
FIG. 16 is a side plan operation view of the first conventional skateboard in accordance with the prior art.
Figure 17:
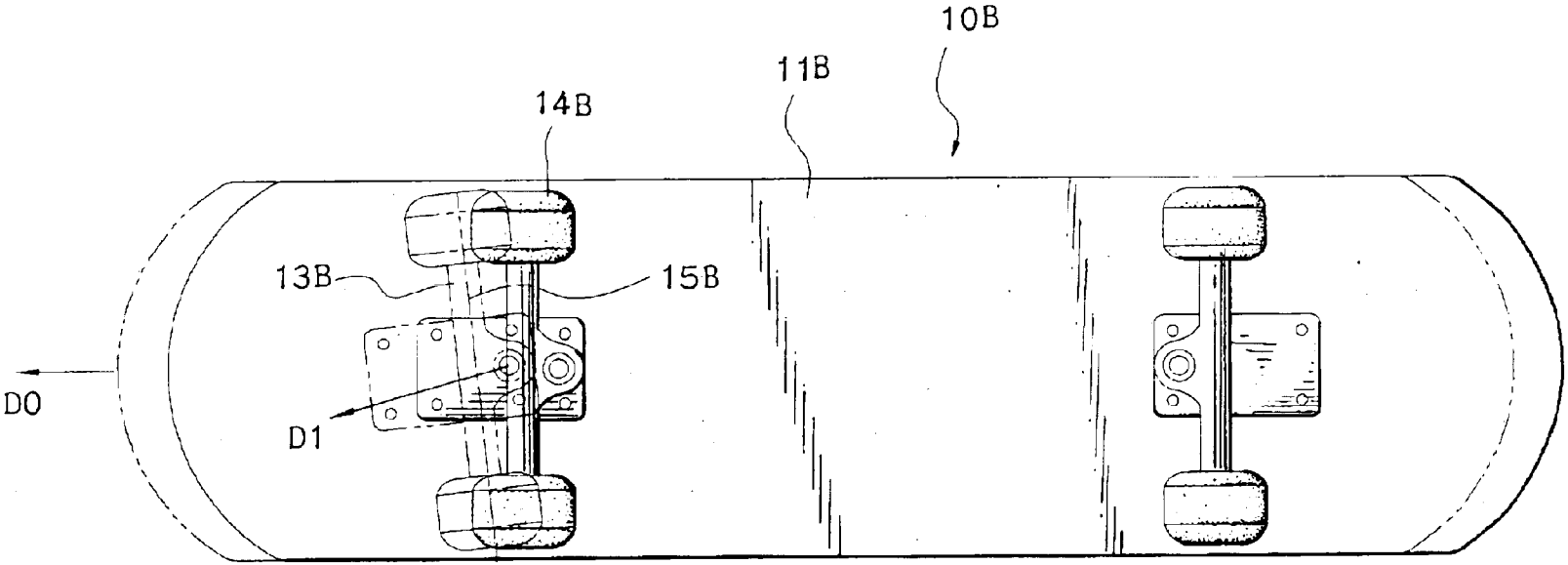
FIG. 17 is a schematic plan operation view of the first conventional skateboard in accordance with the prior art.
Figure 18:
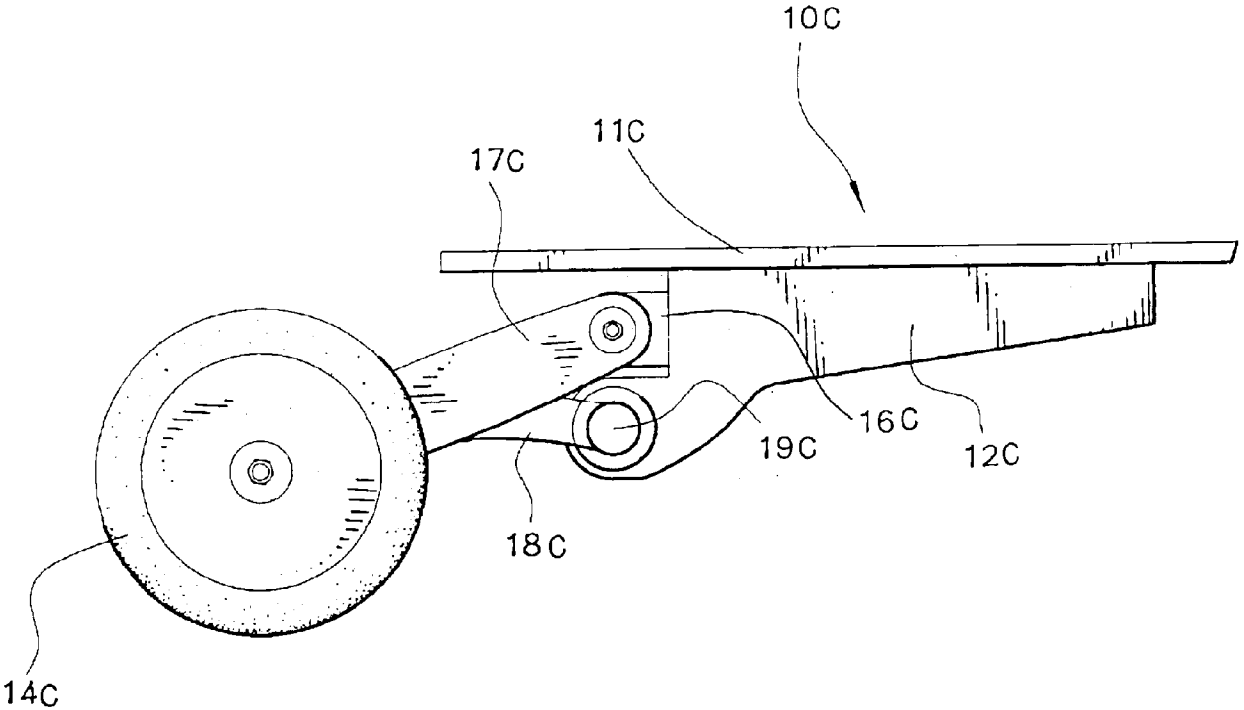
FIG. 18 is a front plan view of a second conventional skateboard in accordance with the prior art.
Figure 19:
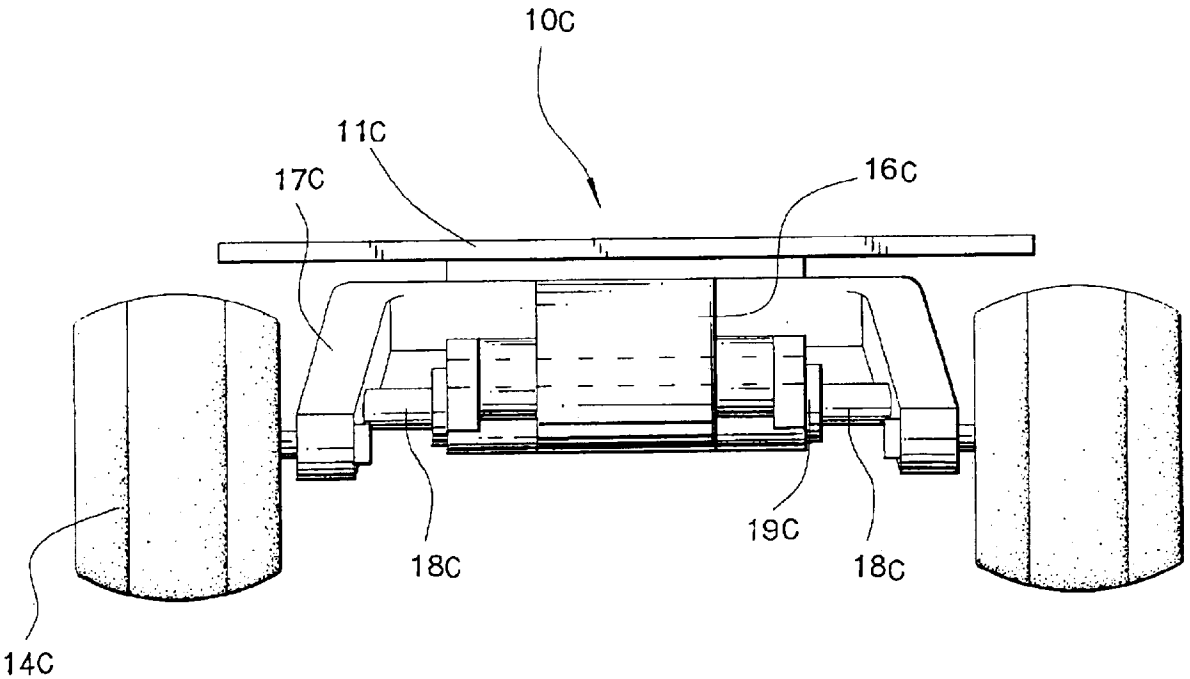
FIG. 19 is a side plan view of the second conventional skateboard in accordance with the prior art.

Referring to FIG. 14, a skateboard 10A having a three-dimensional independent suspension balance system in accordance with another embodiment of the present invention is shown, wherein the second end of each of the two wheel seats 30A is provided with an extension arm 36 extended from the shaft passage portion 34 for passage of the respective wheel axle 31 so as to match the roller 33A of a larger size.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A skateboard comprising:

a board body having a bottom provided with a base;

the base having a bottom provided with two opposite wheel seats;

a main seat mounted between the base and the two wheel seats;

a main seat restoring device mounted between the base and the main seat;

two wheel seat restoring devices each mounted between the main seat and a respective one of the two wheel seats;

each of the two wheel seats including a wheel axle for mounting a roller;

wherein, the wheel axle of each of the two wheel seats has a center located at a height different from that of a center of the respective wheel seat, thereby forming an eccentric state, so that each roller has independent horizontal and vertical displacement, each of the two wheel seats is rotatably mounted on a bottom of the main seat by a wheel seat pivot shaft, and the bottom of the main seat has two ends each provided with a wheel seat receiving portion, the wheel seat receiving portion of the main seat has a first end formed with a guide channel, a second end formed with a receiving channel, and a mediate portion formed with a partition located between the guide channel and the receiving channel.

2. The skateboard in accordance with claim 1, wherein each of the two wheel seats is mounted in the wheel seat receiving portion of the main seat and has a first end and a second end, the first end being formed with a protruding restoring portion movably mounted in the guide channel of the wheel seat receiving portion of the main seat, the restoring portion of each of the two wheel seats has a first side formed with a locking edge that can be moved to abut a wall of the guide channel of the wheel seat receiving portion of the main seat and a second side formed with a resting edge that can be moved to abut the partition of the wheel seat receiving portion of the main seat.

3. The skateboard in accordance with claim 2, wherein the second end of each of the two wheel seats is adapted for passage of a respective wheel axle.

4. The skateboard in accordance with claim 2, wherein each of the two wheel seat restoring devices includes a restoring member mounted in the receiving channel of the wheel seat receiving portion of the main seat and urged between the partition and a wall of the receiving channel, and an urging seat movably mounted in the receiving channel of the wheel seat receiving portion of the main seat and having a first side formed with a fixing portion fixed on a first end of the restoring member and a second side formed with an urging portion urged on the resting edge of the restoring portion of the respective wheel seat, the urging seat is rested on the partition of the wheel seat receiving portion of the main seat, and the urging portion of the urging seat is extended through the partition of the wheel seat receiving portion of the main seat.

5. The skateboard in accordance with claim 4, wherein each of the two wheel seat restoring devices further includes an adjusting seat movably mounted in the receiving channel of the wheel seat receiving portion of the main seat and having a first side formed with a fixing portion fixed on a second end of the restoring member and a second side rested on a wall of the receiving channel of the wheel seat receiving portion of the main seat.

6. The skateboard in accordance with claim 5, wherein each of the two wheel seat restoring devices further includes an adjusting screw screwed into the wall of the receiving channel of the wheel seat receiving portion of the main seat and having an end formed with an urging face urged on the second side of the adjusting seat, the second side of the adjusting seat is formed with a depression to receive the urging face of the adjusting screw.

7. A skateboard comprising:

a board body having a bottom provided with a base;

the base having a bottom provided with two opposite wheel seats;

a main seat mounted between the base and the two wheel seats;

a main seat restoring device mounted between the base and the main seat;

two wheel seat restoring devices each mounted between the main seat and a respective one of the two wheel seats;

each of the two wheel seats including a wheel axle for mounting a roller;

wherein, the wheel axle of each of the two wheel seats has a center located at a height different from that of a center of the respective wheel seat, thereby forming an eccentric state, so that each roller has independent horizontal and vertical displacement, each of the two wheel seats is rotatably mounted on a bottom of the main seat by a wheel seat pivot shaft, and each of the two wheel seats has a mediate portion formed with a shaft passage portion having a center formed with a shaft hole, the wheel seat pivot shaft is extended through the shaft hole of the shaft passage portion of each of the two wheel seats and through the main seat and has two ends each protruding outward from a respective one of the two wheel seats and each threaded thereon with a threaded fixing member so that each of the two wheel seats can be rotated on the main seat about the wheel seat pivot shaft.

8. The skateboard in accordance with claim 7, wherein the wheel axle of each of the two wheel seats is located at a height different from that of the respective wheel seat pivot shaft, thereby forming an eccentric state, so that each roller on the wheel axle has independent horizontal and vertical displacement and has independent buffer displacement.

9. A skateboard comprising:

a board body having a bottom provided with a base;

the base having a bottom provided with two opposite wheel seats;

a main seat mounted between the base and the two wheel seats;

a base receiving portion formed at the top of the main seat has a first side and a second side;

an inverted V-shaped connecting portion rotatably mounted on the base receiving portion of the main seat formed at the bottom of the base, the connecting portion of the base includes:

a first side rotatably mounted on the first side of the base receiving portion of the main seat and a second side provided with an urging portion having a distal end formed with a protruding retaining edge;

a U-shaped urging portion on the base receiving portion of the main seat provided at the second side of the base receiving portion;

a main seat restoring device mounted between the base and the main seat, the main seat restoring device is clamped between the urging portion of the connecting portion of the base and the urging portion of the base receiving portion of the main seat and is retained by the retaining edge, so that the main seat has an automatically restoring function;

a base pivot shaft rotatably mounting a top of the main seat to a bottom of the base; and two wheel seat restoring devices each mounted between the main seat and a respective one of the two wheel seats;

each of the two wheel seats including a wheel axle for mounting a roller;

wherein, the wheel axle of each of the two wheel seats has a center located at a height different from that of a center of the respective wheel seat, thereby forming an eccentric state, so that each roller has independent horizontal and vertical displacement.

10. The skateboard in accordance with claim 9, wherein the first side of the base receiving portion of the main seat is formed with an arcuate guide edge, and the first side of the connecting portion of the base is formed with an arcuate guide edge rested on the guide edge of the base receiving portion.

11. The skateboard in accordance with claim 9, wherein the main seat restoring device includes a restoring member made of an elastic block.

12. The skateboard in accordance with claim 9, wherein the base pivot shaft is extended through the first side of the connecting portion of the base and the first side of the base receiving portion of the main seat and has a distal end threaded together with a fixing member, so that the main seat can be rotated on the base about the base pivot shaft.

13. The skateboard in accordance with claim 12, further comprising a bushing made of wear-resistant material mounted on the base pivot shaft and located between the first side of the connecting portion of the base and the first side of the base receiving portion of the main seat.

14. The skateboard in accordance with claim 9, wherein each of the two wheel seats is rotatably mounted on a bottom of the main seat by a wheel seat pivot shaft.

15. The skateboard in accordance with claim 9, further comprising an adjusting member mounted between the board body and a fixing portion of the base for adjusting the distance between the board body and the base.

* * * * *